United States Patent [19]

Dohrmann

[11] 3,961,509

[45] June 8, 1976

[54] ROLL GAP CONTROL

[75] Inventor: Günter Dohrmann, Neukrug, Germany

[73] Assignee: Vereinigte Flugtechische Werke-Fokker Gesellschaft mit beschrankter Haftung, Bremen, Germany

[22] Filed: May 12, 1975

[21] Appl. No.: 576,566

[30] Foreign Application Priority Data

May 21, 1974 Germany ..... 2424615

[52] U.S. Cl. ..... 72/6

[51] Int. Cl.[2] ..... B21B 37/08

[58] Field of Search ..... 72/21, 8, 20, 6

[56] References Cited

UNITED STATES PATENTS

| | | | |
|---|---|---|---|
| 3,802,236 | 4/1974 | Smith, Jr. | 72/16 |
| 3,850,015 | 11/1974 | Andresen | 72/31 |
| 3,902,114 | 8/1975 | Alich | 72/21 |

*Primary Examiner*—Milton S. Mehr

*Attorney, Agent, or Firm*—Ralf H. Siegemund

[57] ABSTRACT

The roll gap is feedback controlled in that the actual gap is detected, compared with a reference for formation of an error signal which in turn controls the relative position of the rolls. That feedback system is supplemented by augmenting the error by a signal that is directly proportional to the time derivative of the rolling force and of the stock width and inversely proportional to the force itself.

5 Claims, 1 Drawing Figure

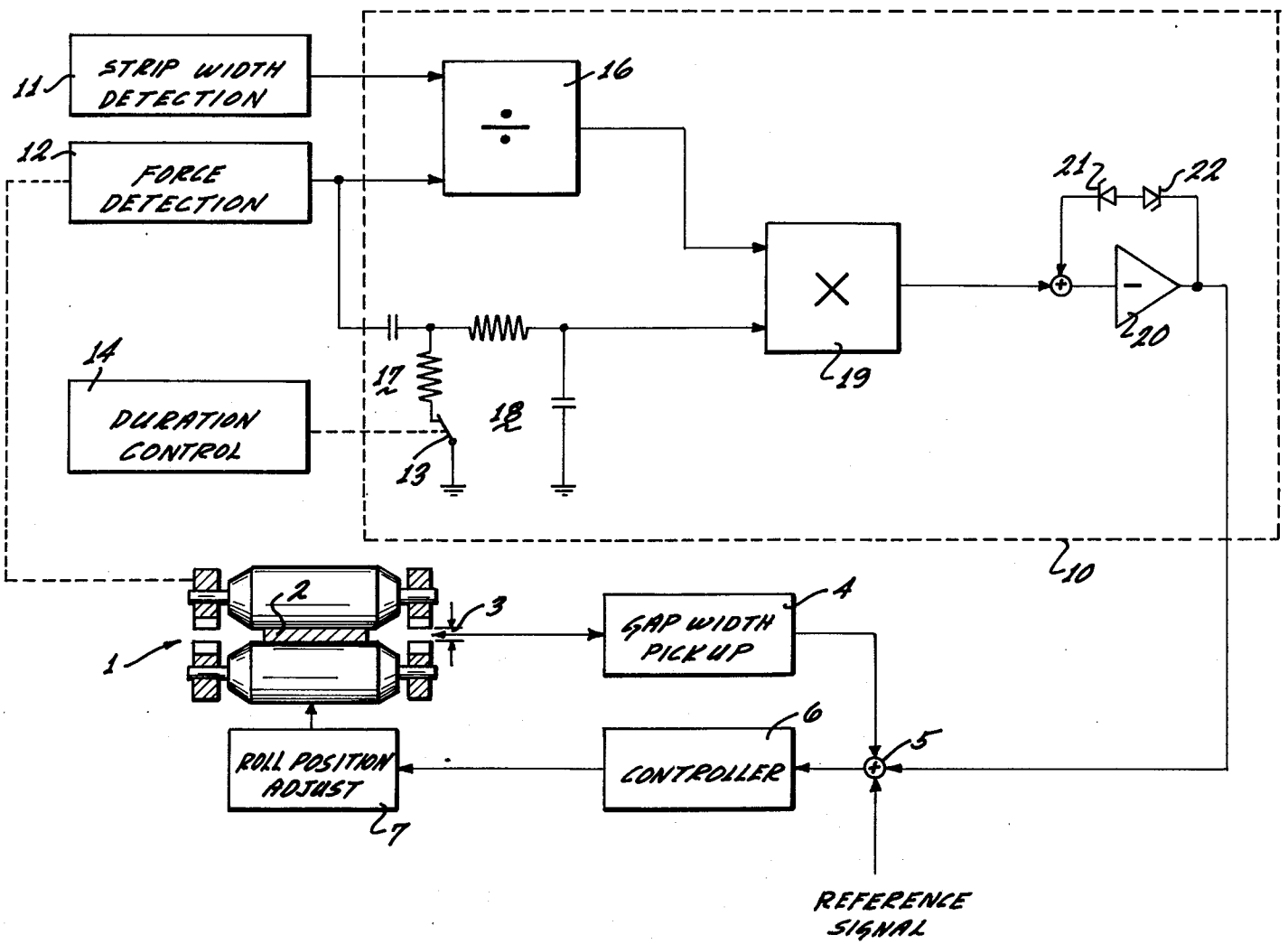
STRIP WIDTH DETECTION
FORCE DETECTION
DURATION CONTROL
GAP WIDTH PICK UP
CONTROLLER
ROLL POSITION ADJUST
REFERENCE SIGNAL
1
2
3
4
5
6
7
10
11
12
13
14
16
17
18
19
20
21
22

ROLL GAP CONTROL

BACKGROUND OF THE INVENTION

The present invention relates to control of the gap between rolls of a rolling mill.

Rolling mills usually have to be controlled for keeping the thickness of the rolled strip constant, i.e. within specified tolerances. The control involves preferably a feedback loop, in which the gap between the working rolls is ascertained, e.g. by a contactless feeler, and the measured value is used as control input to be compared with a reference, and the error signal controls the roll gap. Devices of this type are shown, for example, in U.S. Letters Pat. No. 3,662,576; see also U.S. Pat. No. 3,817,068 and U.S. Pat. No. 3,850,015.

These devices for gap width pickup and detection are quite suitable to provide the primary input for a feedback system. It has to be observed, however, that there is not a 1:1 relation between rolling gap and thickness of the rolled stock. The latter may vary, for example, on account of changes in hardness or the blank that is being rolled varies in thickness. Also, the frame may change, the rolls may blend or flatten and there may be other causes changing the thickness of the rolled stock, even though the gap has remained within the specified tolerances. Swelling of the stock may compound the problem.

In order to offset and avoid these other interferences with the process of rolling stock at constant thickness, other and/or additional controllers are provided. For example, it is known to provide controllers for roll pressure; or for the spindle force or forth roll position. These various controllers, often used in the alternative, are only a partial solution to the whole problem, because they frequently do not respond to the actual source for the impending error, because the respective input transducers are not suited for that purpose or they are at the wrong location or both. Clearly, the closer the tolerances, the more compounded is the problem.

One could, for example, provide for a kind of master control in that the strip thickness itself is the controlled variable, and that thickness itself is ascertained by an appropriate transducer which, through feedback, controls the rolling gap to obtain constant thickness. However, for this particular kind of control it is inherent that the distance — (in the direction of rolling) between thickness measuring transducer and rolling gap, divided by rolling speed defines a period of time in which control cannot possibly be made effective. Also, stability requires relative slow response so that errors are eliminated quite slowly.

DESCRIPTION OF THE INVENTION

It is an object of the present invention to improve the control for obtaining constant thickness of rolled stock and as provided through control of the roll gap to eliminate also interferences other than those based directly on gap or thickness variations as detected when occurring.

In accordance with the preferred embodiment of the invention, it is suggested to superimpose upon a rolling gap control, operating within a feedback loop, a signal that varies in proportion to the width and the derivative of the rolling force, but inversely to the force itself. One can also say that this augmenting signal is to vary in proportion to the time derivative of the rolling force and inversely to the effective rolling pressure. Still alternatively, one can say that this additional control signal varies in proportion with the relative or normalized time derivative of force as well as with the strip width.

The invention is based on the recognition that the rolling force is the prime cause for flattening or bending of the rolls, changes in the frame and also, indirectly, for swelling of the stock. If the force of rolling changes on account of variations in hardness of the stock to be rolled, various kinds of interferences are introduced which in turn affect in one way or another the rolling process in general and the thickness of rolled stock in particular. It was found, however, that relative variation of rolling force when augmenting the gap width or strip thickness control is a very effective way of maintaing the strip thickness constant.

If one assumes, for example, that the stock to be rolled becomes harder, such increase in hardness increases the interaction of forces between rolls and stock and affects the stand, spindle, etc. and that in turn may result in the tendency to increase the roll gap. The direct or indirect gap control (operating as indirect or direct control of the strip thickness) will after a while compensate for that change, so that in spite of the now harder material the gauge thickness of the rolled stock will be as desired. The transition zone, however, will be thicker for a certain length of the rolled stock. That length depends on the time constant of the control, but also on the development in time of the various disturbances in the frame itself as they subsequently affect gap width and strip thickness. Upon using the time derivative (positive in this case) of the force as additional control signal, an error signal is in effect simulated, or the already existing but small error is augmented, to cause the gap control to effect a gap reduction, so that by operation of the interplay, increasing hardness-reducing gap width, the resulting gap and strip thickness remains within the desired tolerances. The effect of the increased hardness on the mill will be less pronounced, if the rolling force is large to begin with, which is the reason for the generation of the relative force derivative (i.e. of the ratio of derivative over absolute value). The effect on the stand will be the larger, the wider this harder strip is, which is the reason that the augmentation of control should be directly proportional to width.

The inventive system is, therefore, particularly suitable to provide for constant width of the rolled stock in those cases where the time constant of the gap width control is insufficient. This is true, regardless of whether the gap width control is based on directly ascertaining the resulting width of the rolled stock or of the roll gap. In other words, the added control parameter as based on force and strip width can be introduced into a control circuit for roll gap width regardless whether the controlled variable as detected is that width or the resulting strip thickness.

It can thus be seen that the invention can be practiced in a control circuit, which includes a primary feedback loop, in which control is exerted upon the roll gap and in which the controlled variable is the gap width itself or the strip thickness. An error signal is formed in the loop (negative summation of controlled variable and reference), which error signal represents the deviation of the existing from the necessary condition for rolling, and the augmenting control is superimposed upon the error signal. The composite resultant here controls the means which determine and adjust roll gap width. In general terms, the frequency response of such a feedback system is extended to higher frequencies for the error when one uses the supplementation and augmentation as per this invention.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE illustrates a block diagram and schematic view of a system in accordance with the preferred embodiment of the invention.

Proceeding now to the detailed description of the drawings, the FIGURE illustrates schematically the rolling mill 1 for rolling stock 2 and at thickness that is determined (in parts) by the roll gap 3. That gap is ascertained by a transducer 4 of the type shown in the above identified patents. The transducer feeds a summing point 5 for the formation of an error signal, and a controller 6 controls the roll gap adjuster 7. The summing point receives a reference signal representing the desired roll gap width. Thus far, the feedback system is conventional.

In accordance with the preferred embodiment, another signal is fed to the summing point 5, which is developed by a circuit 10. Circuit 10 processes several input signals which are acquired as follows. Reference numeral 11 refers to a transducer or transducer system which ascertains the width of the rolled stock 2. The width will be measured before, the working rolls of the mill. The width can be ascertained on a running basis by means of feelers which engage the strip laterally and their deflection is added to obtain a representation of the strip width.

A transducer 12 responds to and measures the absolute rolling force, i.e. the total force as exerted by the rolls against the stock as it is being rolled. These transducers 12 may be constructed, for example, as strain gauges placed, for example, right at the bearings of the working rolls to measure the force exerted by the rolls upon the stand. A portion of the force as exerted by the strip upon the rolls is, of course, reacted into the rolls. That, however, is of no consequence, because, as stated above, the prime parameter of interest is the relative time derivative of the force, so that the portion that was reacted into the rolls is eliminated anyway.

The two signals respectively representing width of and force as exerted on the rolled stock are fed to a signal and algebraic divider stage 16, whose output signal is the quotient, width over force. The output of force measuring transducer is additionally passed through a differentiating-circuit constructed as band pass filter which is composed of a high pass filter 17 and a low pass filter 18 serially connected thereto. The output signal of the latter represents the change in time of the rolling force, i.e. the time derivative thereof.

The change-of-rolling force signal is fed to a multiplier circuit 19, wherein this signal is algebraically multiplied with the quotient signal from divider 16. In other words, the circuits 16 and 19 together form a signal which is the product of a repesentation for strip width and of the relative or normalized derivative of force, i.e. time derivative of force over force. The output of that circut 19 is fed to an amplifier 20, which adjusts the level of the signal to a level suitable for superpositioning upon the error signal as formed in summing point 5.

The circuits 16 and 19 are conveniently analog circuits, basically networks in which signals are divided and multiplied. However, one could digitize the signals, and provide for these arithmetic operations on a digital basis. If, for example, the controller 6 includes digital networks, time and function sharing may make it advisible to utilize available digital arithmetic capabilities to obtain product and quotient signals.

The amplifier 20 has an input terminal 15, to which is also connected a feedback circuit comprised of two, back-to-back connected diodes, which act as bi-directional limiter, to limit the output of amplifier 20. The amplifier output is the output of circuit 10 to serve as additional input for summing point 5.

The signal which is added to and actually superimposed upon the error signal is predominantly determined by the derivative of the rolling force. One can also say that the augmenting signal from circuit 10 is super-imposed upon the feedback signal from transducer 4, representing the controlled variable to obtain a composite control signal; the reference signal being an additional modifier. Still alternatively, one can say that the signal from circuit 10 is used as modifier for the reference signal in that control loop.

Regardless of its interpretation, the signal from circuit 10 is introduced into the feedback roll gap control loop as anticipation signal to initiate control even though the roll gap itself may yet not have significantly changed. This anticipatory signal is modified by the said quotient. Generally, the anticipatory control should be made dependent upon several different parameters such as the force itself, the width of the stock, the reduction per pass, the material of the stock and the diameter of the rolls. However, it was found that it suffices if the force derivative is made relative, i.e. if the derivative is divided by the absolute force value. On the other hand, width of the stock and force having opposing or reciprocate effects on any error, so that the width/force ratio is used as modifier for the time derivative of the force. The other parameters mentioned are system parameters and can be assumed to be constant. In the essence, they are reflected in the amplifier gain of amplifier 20. It was found best to ascertain that value emperically.

The FIGURE shows additionally a switch 13 and a control 14 for that switch. The switch is illustrated in the normal operating position, in which the high pass 17 is fully effective. If, however, switch 13 opens, the connection to ground of the high pass is interrupted which in effect reduces the time constant of the band pass filter 17–18. Particularly, the capacitor of high pass 17 will charge more rapidly. The resistances in high pass and low pass are preferably proportioned at a ratio of 1:1000.

It was found that reducing the time constant in the band pass during start up of the rolling mill speeds up the control at that point. However, after steady conditions have been attained, the switch 13 should be closed as otherwise the system may be prone to hunt. The control 14 of switch 13 is carried out, for example, in response to strip feeding plus a predetermined delay.

It was found that the circuit in accordance with the invention offers the advantage that virtually all of the various kinds of interferences that affect strip thickness are ascertained, of course, in conjunction with the primary control of the roll gap. Optimization of the system as such is actually a matter of amplifier gain with amplitude limitation. The circuit configuration permits the providing of a non-linear characteristic with gradually increasing effectiveness of amplitude limiting as regards the output of 10. The limiting proper, and in absolute terms, has the effect of protection. For example, very large (and fast) changes in rolling force may be indicative of tears in the strip. In any event, driving the controller 6, 7 into saturation should be duly avoided.

The circuit shown is used in conjunction with a roll gap feedback control, using the roll gap as input and controlled variable. However, one could instead use the thickness of the rolled stock to be measure downstream of the rolls. The roll gap would still be controlled as described and the control augmentation as per this invention could also be used.

I claim:

1. In an apparatus for controlling the gap between the rolls of a mill in response to an error signal which represents deviation of the necessary condition for rolling from the existing one, the apparatus including means being responsive to that error signal to control the relative position between the rolls, the improvement comprising:

means for detecting the force as exerted by the rolls and providing a first signal representing said force, and a second signal representing the time derivative of said force;

means for detecting the width of the stock and providing a third signal representative thereof; and circuit means connected to receive the first, second and third signals and providing a composite signal and superimposing it upon said error signal.

2. In an apparatus as in claim 1, wherein the circuit means provides for multiplication and division to obtain the product of the second and third signal and division by the first signal.

3. In an apparatus as in claim 2, wherein the circuit means includes an amplifier for the composite signal and means for limiting the amplitude thereof, to prevent said composite signal from saturating the control in response to the error signal.

4. In an apparatus as in claim 1, wherein said means for detecting includes a band pass filter.

5. In an apparatus as in claim 4, wherein said band pass has variable time constant, there being means connected to the band pass for changing the time constant thereof for extending the time constant after completion of startup.

* * * * *